US006250297B1

(12) United States Patent
Matlock

(10) Patent No.: US 6,250,297 B1
(45) Date of Patent: Jun. 26, 2001

(54) FIREPLACE ASH REMOVAL SYSTEM

(76) Inventor: Byron Lloyd Matlock, 8730 Volunteer Dr., New Port Richey, FL (US) 34653

( * ) Notice: Subject to any disclaimer, the term of this patent is extended or adjusted under 35 U.S.C. 154(b) by 0 days.

(21) Appl. No.: 09/651,017

(22) Filed: Aug. 30, 2000

(51) Int. Cl.[7] ..... F23J 1/00
(52) U.S. Cl. ..... 126/554; 126/242; 110/165 R
(58) Field of Search ..... 126/242, 554; 110/165 R; 15/300.1, 301

(56) References Cited

U.S. PATENT DOCUMENTS 186,013 * 1/1877 Linsley ..... 126/554
1,716,029 * 6/1929 Clark ..... 126/554
3,409,002 * 11/1968 Vackar ..... 126/242
3,416,514 * 12/1968 Klemme ..... 126/242
3,998,385 12/1976 Ogle .
4,074,680 2/1978 Gooding .
4,096,848 6/1978 Richman .
4,136,666 1/1979 Haas .
4,266,525 5/1981 Hall .
4,807,590 * 2/1989 Evans ..... 126/242

* cited by examiner

*Primary Examiner*—Carl D. Price
(74) *Attorney, Agent, or Firm*—Larson & Larson, P.A.; James E. Larson

(57) ABSTRACT

A grate at the bottom of a hearth leads to a funnel shaped ash hopper and then to an ash removal pipe conduit. An electrical motor creates a vacuum in a canister located at an end of the pipe conduit distal from the ash hopper. An electric switch in a residence containing the hearth actuates the motor and causes cooled ash to move from the hearth to the canister where it can be removed for off site disposal.

6 Claims, 3 Drawing Sheets

FIREPLACE ASH REMOVAL SYSTEM

BACKGROUND OF THE INVENTION

This invention relates to a fireplace ash removal system. More particularly, it refers to a vacuum unit used to suck ash through a pipe from a residence fireplace to a container located outside the residence.

It is common for a residence to contain one or more fireplaces for the pleasure of their occupants. Unfortunately, the ash, produced by wood burning fireplaces which are the most popular, causes a nuisance problem in disposal. A motor driven auger as described in U.S. Pat. No. 4,074,680 can drive the ash down to a pit located below the grate. The ash still has to be eventually removed from the ash pit. In U.S. Pat. No. 4,096,848, a basementless house has an ash removal system in which an auger extends under a floor to an ash removal pit at a side of a house. Although these systems assist in the disposal of ash, they still require the householder to deal with ash disposal. A system is needed which will remove ash without the need for further handling by the householder.

SUMMARY OF THE INVENTION

The invention herein described and claimed solves the prior problem of handling cold ash by providing a fully automatic system for transporting the ash from a fireplace directly to a closed container without the need for actuating an auger. The container can be disposed of without the need to deal with ash.

One or more fireplace hearths or a brick pizza oven is connected through a bottom grate and a funnel shaped ash hopper to a pipe conduit leading under a building slab to an outside area where a motor driven vacuum unit including a canister for retaining cold ash is located. The motor is electrically driven by actuating a switch inside the building or outside the building. A solenoid operated fresh air inlet is closed when the motor is creating a vacuum and open to emit fresh air to the system when the motor is not operating.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
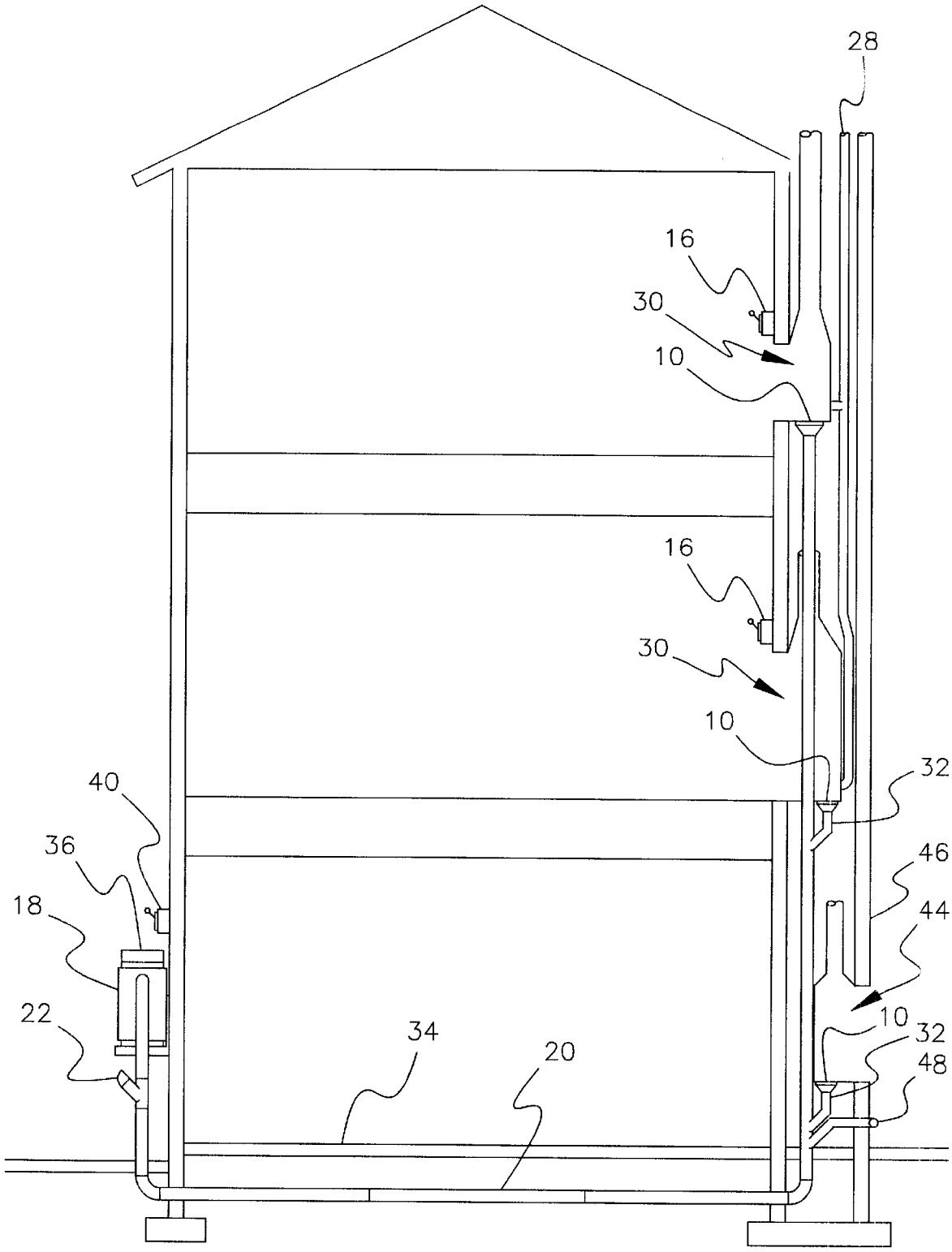
FIG. 1 is a front view in elevation of a building containing the fireplace ash removal system of this invention.
Figure 2:
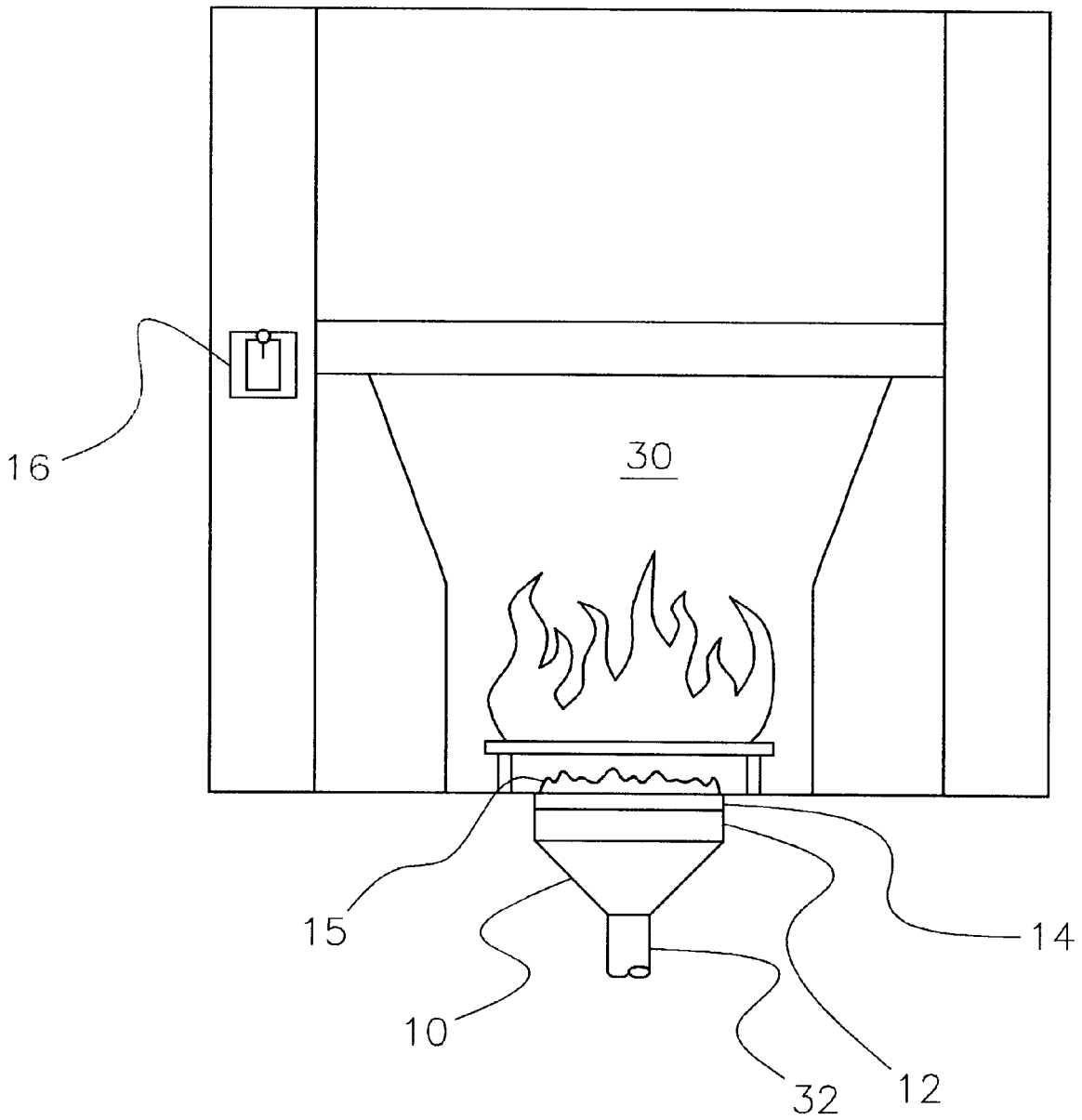
FIG. 2 is a front view of a fireplace linked to the ash removal system.
Figure 3:
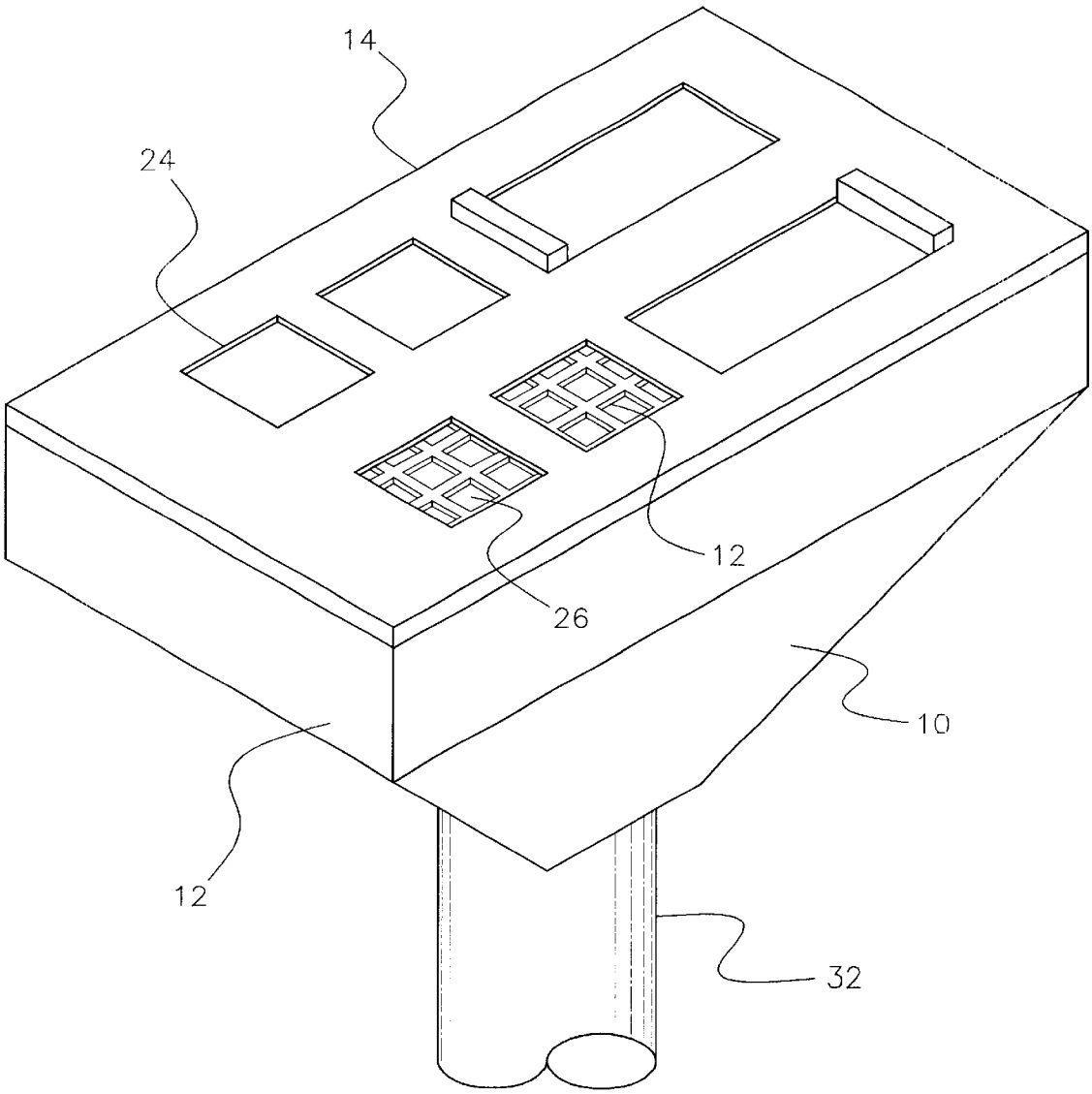
FIG. 3 is a partial sectional view of the fireplace hearth bottom plate and the ash receiving grate.

Throughout the following detailed description the same reference numerals refer to the same elements in all figures.

Referring to FIG. 1, the fireplace ash removal system includes a funnel shaped ash hopper 10 located below the hearth of a fireplace 30. An inner grate 12 having openings 26 suitable only for receipt of ash 15 is fixedly mounted over hopper 10. A removable plate 14 containing air vents 24 is located over inner grate 12 and remains in place while the fireplace is in use or contains hot ash. Plate 14 is removed before operation of the ash removal system.

Hopper 10 empties into an auxiliary pipe 32 leading to a tube or main pipe conduit 20. Main pipe conduit 20 is located below a building slab 34 and empties into canister 18.

A motor 36 located above canister 18 is electrically operated by an indoor switch 16, or alternatively, by outdoor switch 40. Generally, the canister 18 is located outside a building wall 42 distal from the fireplaces 30. A pizza oven 44 located on an opposite wall 46 of the building can be incorporated into the ash removal system. An auxiliary tube 48 leads from an outside area adjacent the pizza oven 44 to the main pipe conduit 20 for use in removing small particles in the vicinity of the pizza oven.

Motor 36 has a horsepower of 1–2 to create a vacuum suction in the system of 200 to 250 cubic feet per minute within the main pipe conduit 20 so that ash can be moved from the pizza oven 44 or the fireplaces 30 directly to canister 18. A 1½ horsepower motor creates about 217 cubic feet per minute air suction. The canister is removable for disposal of the ash off site.

A solenoid operated fresh air inlet 22 remains open to admit fresh air when the system is not operating.

An air vent 28 permits fresh air to enter the indoor fireplaces 30.

The system is actuated by switch 16 after the ash 15 is cold and the plate 14 is removed. Ash is drawn downward by the vacuum through inner grate 12, hopper 10, auxiliary pipe 32 and main pipe conduit 20 and is sucked outwardly to canister 18 where it is stored until filled. It is then emptied off site and the canister is replaced.

All parts of the system is made of metal and joints on pipe conduit 20 are flame sealed to prevent escape of ash.

The above description has described specific structural details embodying the invention. However, it will be within one having ordinary skill in the art to make modifications without departing from the spirit and scope of the underlying inventive concept of this system.

Having described the invention in detail the following is claimed:

1. A fireplace ash removal system comprising:

at least one fireplace as part of a residence, the fireplace having a hearth with a bottom grate for preventing unburnt wood products from falling downward;

a funnel shaped ash hopper below the grate leading to a first end of an ash removal tube;

an electrical motor driven vacuum inducing canister located outside the residence connected to the ash removal tube at an opposite end from the ash hopper, the ash removal tube located for a substantial portion of the tube length below the lowest floor of the residence, the vacuum inducing canister operated by actuation of a switch within the residence when ash accumulated in the hearth is no longer hot and a plate over the grate is removed;

a solenoid operated fresh air inlet adjacent the canister, closed when the canister vacuum is operating and open when the canister vacuum is not operating, the fresh air inlet leading to the ash removal tube from a location outside the residence; and a means for permitting fresh air to circulate in the hearth.

2. The fireplace ash removal system according to claim 1 wherein the residence has a first floor and second floor fireplace connected to the ash removal system.

3. The fireplace ash removal system according to claim 1 wherein a pizza oven is connected to the ash removal system.

4. A fireplace cold ash removal system comprising:

(a) a pipe conduit adapted to receive the cold ash, the pipe conduit having a first opening below a hearth, a substantial portion of the pipe conduit located under a slab supporting a building, the pipe conduit leading from the first opening to a second opening of the pipe leading into a disposable canister outside the building;

(b) a solenoid operated fresh air inlet to the pipe conduit adjacent the canister;

(c) a vacuum inducing electrically operated motor in the canister to draw cold ash from the hearth;

(d) an electrical switch within the building to activate the motor;

(e) a removable plate over the first opening to permit the flow of cold ash into the first opening when the plate is removed and the motor is activated; and (f) a means for permitting fresh air to flow into the hearth.

5. The fireplaces cold ash removal system according to claim 4 wherein a funnel shaped ash hopper is located under the hearth to direct the cold ash to the pipe conduit first opening.

6. The fireplace cold ash removal system according to claim 5 wherein a grate having openings sufficient to allow passage of ash but insufficient to permit passage of unburnt materials is located below the hearth and above the ash hopper.

* * * * *